United States Patent [19]

Caplan et al.

[11] 4,231,197

[45] Nov. 4, 1980

[54] BUILDING SYSTEM EMPLOYING PREFABRICATED WALL PANELS

[75] Inventors: Sidney W. Caplan, Mayfield; William N. Molson, Cleveland, both of Ohio

[73] Assignee: Component Systems, Inc., Cleveland, Ohio

[21] Appl. No.: 879,194

[22] Filed: Feb. 21, 1978

[51] Int. Cl.[2] ..... E04H 1/00; E04B 2/72

[52] U.S. Cl. ..... 52/36; 52/205; 52/239; 52/241; 52/282; 52/747; 52/749

[58] Field of Search ..... 52/36, 239, 241, 282, 52/747, 749

[56] References Cited

U.S. PATENT DOCUMENTS

| | | | |
|---|---|---|---|
| 175,796 | 4/1876 | Wanda | 52/278 |
| 1,168,131 | 1/1916 | Walsh | 52/408 |
| 1,440,615 | 1/1923 | Meyercord | 52/631 |
| 1,899,653 | 2/1933 | Venzie | 52/404 X |
| 2,065,433 | 12/1936 | Dercum et al. | 52/272 |
| 2,321,567 | 6/1943 | Wilson | 52/779 X |
| 2,331,752 | 10/1943 | Wilson | 52/514 X |
| 2,358,143 | 9/1944 | Castor | 52/100 |
| 2,378,275 | 6/1945 | Williamson | 52/92 |
| 2,381,635 | 8/1945 | Baker | 52/241 |
| 2,568,133 | 9/1951 | Swisher, Sr. et al. | 52/275 |
| 2,621,378 | 12/1952 | Wilson | 52/582 |
| 2,645,287 | 8/1953 | Jones | 308/3 R X |
| 2,686,341 | 8/1954 | Ford et al. | 49/63 |
| 2,892,192 | 6/1959 | Thyer | 52/748 |
| 3,023,464 | 3/1962 | Zerbe | 52/173 R |
| 3,093,218 | 6/1963 | Peterson | 52/241 |
| 3,336,710 | 1/1970 | Schneller et al. | 52/241 |
| 3,466,821 | 9/1969 | O'Shaughnessey et al. | 52/241 |
| 3,668,827 | 6/1969 | Schwartz | 52/36 |
| 3,778,939 | 12/1973 | Nelsson | 52/36 |
| 3,813,832 | 6/1974 | Caplan | 52/206 |
| 4,016,690 | 4/1977 | Richardson | 52/282 X |

FOREIGN PATENT DOCUMENTS

| | | | |
|---|---|---|---|
| 579149 | 7/1959 | Canada | 52/36 |
| 2448983 | 4/1976 | Fed. Rep. of Germany | 52/241 |
| 750973 | 6/1933 | France . | |
| 1084219 | 7/1954 | France . | |
| 1413984 | 9/1965 | France | 52/282 |
| 1523484 | 3/1968 | France | 52/241 |
| 92342 | 1/1920 | Switzerland . | |
| 143526 | of 1921 | United Kingdom | 52/282 |
| 562028 | 6/1944 | United Kingdom . | |
| 1081423 | 8/1967 | United Kingdom | 52/282 |
| 1334820 | 10/1973 | United Kingdom | 52/241 |

OTHER PUBLICATIONS

Richwall Partition System, hereafter Richwall, 1631 Sublette, St. Louis, Mo. 63110, 1975 3 pages.

A-Wall 200 Partition System, hereafter A-Wall 200, Component Systems, Cleveland, Ohio 44131, 7-1976, 2 pages.

*Primary Examiner*—Alfred C. Perham

*Attorney, Agent, or Firm*—Burge & Porter Co.

[57] ABSTRACT

A building system is disclosed for constructing non-load-bearing walls in a building having preexisting ceiling and floor structures, using substantially dimensionally identical, lightweight wall panels. The wall panels are rectangular and each has a pair of facing sheets adhesively bonded to a plurality of elongate spacers. The facing sheets of each wall panel overlie each other and have aligned side and end surfaces which define sides and ends of the wall panel. Outer ones of the spacers are inset from the sides of their wall panel, whereby the back surfaces of the facing sheets and the outer spacers cooperate to define channels along the sides of the panels. Preformed elongate ceiling and floor runners are secured to the ceiling and floor structures, and the wall panels are positioned, one at a time, in mating engagement with the floor and ceiling runners to form continuous walls. Preformed elongate juncture members frictionally engage side portions of adjacent wall panels and extend between the ceiling and floor runners. The runners and juncture members are arranged so that they perimetrically engage the sides and ends of the wall panels to rigidify the wall panels and to interconnect adjacent wall panels. A plurality of specially formed junction members interconnect the wall panels to form corners, to cap exposed ends of wall panels, and to frame door and window openings formed through and between wall panels. A specially configured juncture member assembly is provided for use where it is required to give a wall the capability to releasably mount shelves and cabinets. The building system utilizes frictionally interfitting components wherever possible to eliminate the need for driven fasteners, whereby damage to wall panels is minimized and panel reusability is maximized.

37 Claims, 17 Drawing Figures

BUILDING SYSTEM EMPLOYING PREFABRICATED WALL PANELS

BACKGROUND OF THE INVENTION

1. Field of the Invention

The present invention relates generally to a system for forming non-load-bearing walls of a building utilizing prefabricated, dimensionally identical, light-weight wall panels, the sides and ends of which are perimetrically supported by juncture members and by floor and ceiling runners.

2. Prior Art

Prefabricated building systems have been proposed to facilitate the erecting of walls in buildings. Many prefabricated building systems employ panels which are dimensionally different, one from another, and which are specially tailored to a specific building plan. Such systems have many disadvantages, including:

A. The manufacture of the panels is expensive because variations in panel construction and size:
   (i) prevent true production efficiencies that can only be achieved by repetitively producing identical panels;
   (ii) require substantial engineering and drafting time for each building plan;
   (iii) necessitate that all panels be carefully and individually marked for identification so that each can be installed at its appropriate location;
   (iv) necessitate that panels be fabricated in a particular order rather than produced at an optimum time and stocked for prompt delivery; and,
   (v) increase the probability of mistakes occurring during production of the panels.

B. The erection of walls utilizing such panels is unduly costly because:
   (i) time is lost in searching for panels so that they can be erected in appropriate sequence;
   (ii) where the differences between some of the panels are small, or if there has been an error in marking, the panels can easily be confused and improperly installed during construction—and, once an improper panel has been put in position, it is often difficult and expensive to fully correct the mistake which may, by the time of its discovery, already have resulted in the cumulative dimensional displacement of several subsequently positioned wall panels;
   (iii) if a panel is damaged in transit or at the construction site, expensive delays can occur while a replacement panel is fabricated; and,
   (iv) many specialized wall panels are heavy and typically require the use of special equipment or the use of an unduly large number of workmen in order to position the panels, thereby increasing installation expense.

One approach which has been taken to obviate the foregoing problems is described in U.S. Pat. No. 3,813,832, issued June 4, 1974, entitled WALL FRAMING SYSTEM USING PREFABRICATED PANELS, assigned to the assignee of the present invention, hereafter the "Framing System Patent." The system described in the Framing System Patent employs three types of framing panel structures, namely door, window and wall panels. The wall panels are dimensionally identical one with another and are, accordingly, completely interchangeable. Since the wall panels are dimensionally identical, the manufacturing disadvantages noted above are obviated. The window and door panels vary in width in accordance with the width of the window and door openings they define, each of these panels being essentially as narrow as the required opening-defining framework will permit.

The building system described in the Framing System Patent is principally intended for use in framing load-bearing walls of a building structure such as a home or residential garage. Wall panels are abutted to frame walls between adjacent window and wall panels. If less than a full wall panel is needed adjacent a window or door panel, a wall panel is cut to proper width. Wall panel scrap is minimized, where practicable, by using each cut-off wall panel portion as the next wall framing component to be erected.

A problem not addressed by the Framing System Patent is that of erecting interior, non-load-bearing walls with dimensionally identical wall panels which can be disassembled at a later time to permit repositioning of walls with reuse of the wall panels. While the need for a building system employing lightweight, prefabricated wall panels has been acknowledged in the prior art, many proposals addressing this problem have:

A. required extensive fastening of wall panels along regions of juncture with adjacent panels, with ceiling and floor formations, with corner formations, and with door and window formations, whereby panel disassembly is rendered difficult and panel reusability may be diminished; and, B. necessitated the filling and taping of wall and panel joints in order to cover the locations of installed fasteners, thereby substantially increasing the problems encountered when the panels are removed and an attempt is made to reuse the panels.

Where proposals for wall erection systems have not required extensive use of fasteners and/or joint filling, the panels have tended to be either unduly heavy, complex and expensive, or have resulted in relatively weak, structurally unacceptable wall constructions.

SUMMARY OF THE INVENTION

The present invention overcomes the foregoing and other drawbacks of prior proposals and provides a novel and improved building system for forming non-load-bearing walls utilizing prefabricated wall panels. The system finds particularly advantageous use in the formation of interior building walls, office space dividers, and in-plant offices. The system features low material costs and fast, easy erection.

In the preferred practice of the present invention, dimensionally identical wall panels are fabricated with each of the panels having a pair of facing sheets secured to and held in spaced relationship by a plurality of elongate spacers. The facing sheets are preferably gypsum wallboard panels of a standard size such as four feet wide by eight feet high, and having a nominal thickness of one half inch. In preferred practice, the gypsum wallboard panels are precovered with a vinyl or porcelain finished metal cover. The elongate spacers are preferably formed from a rigid, noncombustible expanded perlite-containing material and are preferably bonded to the facing sheets using a non-combustible adhesive. The resulting wall panels are exceptionally rigid despite their thinness, and are light in weight, fire resistant, and economical to fabricate. The panels feature what is known in the art as "stressed skin" construction in their utilization of rigidly spaced facing sheets. Moreover, the panels may be insulated to enhance sound absorption.

The facing sheets each have front and back surfaces interconnected by top and bottom end surfaces, and by first and second opposed side surfaces. The facing sheets of each panel extend in overlying relationship with their associated side and end surfaces being aligned and cooperating to define top and bottom ends, and first and second sides of their wall panel. The spacers include a pair of outer spacers which extend between the back surfaces of the associated facing sheets at positions spaced inwardly from the aligned side surfaces of the facing sheets, whereby first and second sidewardly facing channels are provided along the first and second sides of each wall panel. The spacers also preferably include at least one inner spacer located between the outer spacers. The inner spacer or spacers are preferably positioned at different distances from the opposite sides of the panels so that, if the panel needs to be cut to form a wall of desired length, the line of cut can be measured from one or the other sides of the panel to position the line of cut at a location where it will not intersect any of the inner spacers.

A system of ceiling and floor runners and juncture members is provided to perimetrically engage the ends and sides of the wall panels when the panels are installed in side-by-side relationship to form a continuous wall. The ceiling runner is preferably formed in two elongate parts which are interfittable. The ceiling runner is adapted to be secured to a pre-existing ceiling structure and is adapted to receive the top end region of at least one of the wall panels. The ceiling runner has a pair of depending portions which are adapted to extend from the ceiling structure to positions overlying top portions of the front surfaces of both facing sheets of the wall panels. The floor runner is adapted to be secured to the pre-existing floor structure of a building and is adapted to receive the bottom end of at least one of the wall panels. The floor runner has supporting formations adapted to support the bottom end of the wall panels at a position above the floor structure, and has a pair of upwardly extending portions adapted to extend from the floor structure to positions overlying bottom portions of the front surfaces of both facing sheets of the wall panels. The ceiling and floor runners are installed on the ceiling and floor structures, respectively, along locations where a new wall is to join the floor and ceiling structures.

The juncture members used between adjacent wall panels forming a contiguous, planar wall are of elongate form and are of substantially C-shaped cross section. These juncture members will be referred to as the "primary" juncture members inasmuch as they are the most commonly employed of several types of juncture members used in the system of the present invention. The primary juncture members are adapted to be installed between the ceiling and floor runners, and each is adapted to be received in one of the side channels of one of the wall panels. Each primary juncture member has opposed surfaces adapted to be frictionally engaged by the back surfaces of the facing sheets of a wall panel. Additionally, each primary juncture member is adapted to be positioned within communicating side channels of two abutting wall panels to bridge the plane of juncture between the abutting wall panels with opposed surfaces of the juncture member frictionally engaging the back surfaces of the facing sheets of the abutting wall panels.

After the ceiling and floor runners have been installed, a first one of the wall panels is installed to form a first portion of a new wall by positioning the bottom end of the first wall panel in engagement with the supporting formations of the installed floor runner. The top end of the first wall panel is then positioned in engagement with the installed ceiling runner, and the wall panel is positioned longitudinally relative to the installed ceiling and floor runners to bring the first wall panel to a desired location where the first side of the first wall panel forms one end of the new wall. A first one of the primary juncture members is then installed in the second side channel of the installed first wall panel, the first juncture member being installed such that it extends between the floor and ceiling runners and such that it is frictionally received between the back surfaces of the facing sheets of the first wall panel. The first juncture member is positioned such that it has portions which protrude from the second side channel of the first wall panel for extension into the first side channel of a second wall panel.

A second wall panel is then installed to provide an extension portion of the new wall. Installation of the second wall panel is effected in substantially the same manner as the first wall panel with the exception that, during longitudinal positioning of the second wall panel it is brought to a position where the first juncture member extends into its first side channel and to a position where its first side abuts the second side of the first wall panel. Additional primary juncture members and wall panels are installed as required to continue the new wall. As the terminus of the new wall is approached, a final wall panel is cut, if required, to fill the space between the last installed full size wall panel and the desired wall end location.

A number of specially configured juncture members are provided to facilitate the formation of corner connections, the covering of exposed side and end portions at the terminus of walls, the framing of door and window openings formed through and between wall panels, and to facilitate the removable mounting of shelves and cabinets on the resulting walls. The runners and the specially configured juncture members are preferably formed as pre-finished aluminum extrusions. The primary juncture members are preferably conventional steel studs which are commercially available at relatively low cost from most building supply houses. Wherever possible, the building system utilizes frictionally interfitting components to eliminate the need for driven fasteners, whereby damage to wall panels is minimized and panel reusability is maximized.

As will be apparent from the foregoing summary, it is a general object of the present invention to provide a novel and improved building system for constructing walls of a building utilizing prefabricated wall panels.

Other objects and a fuller understanding of the invention may be had by referring to the following detailed description and claims taken in conjunction with the accompanying drawings.

DESCRIPTION OF THE PREFERRED EMBODIMENT

Figure 1:
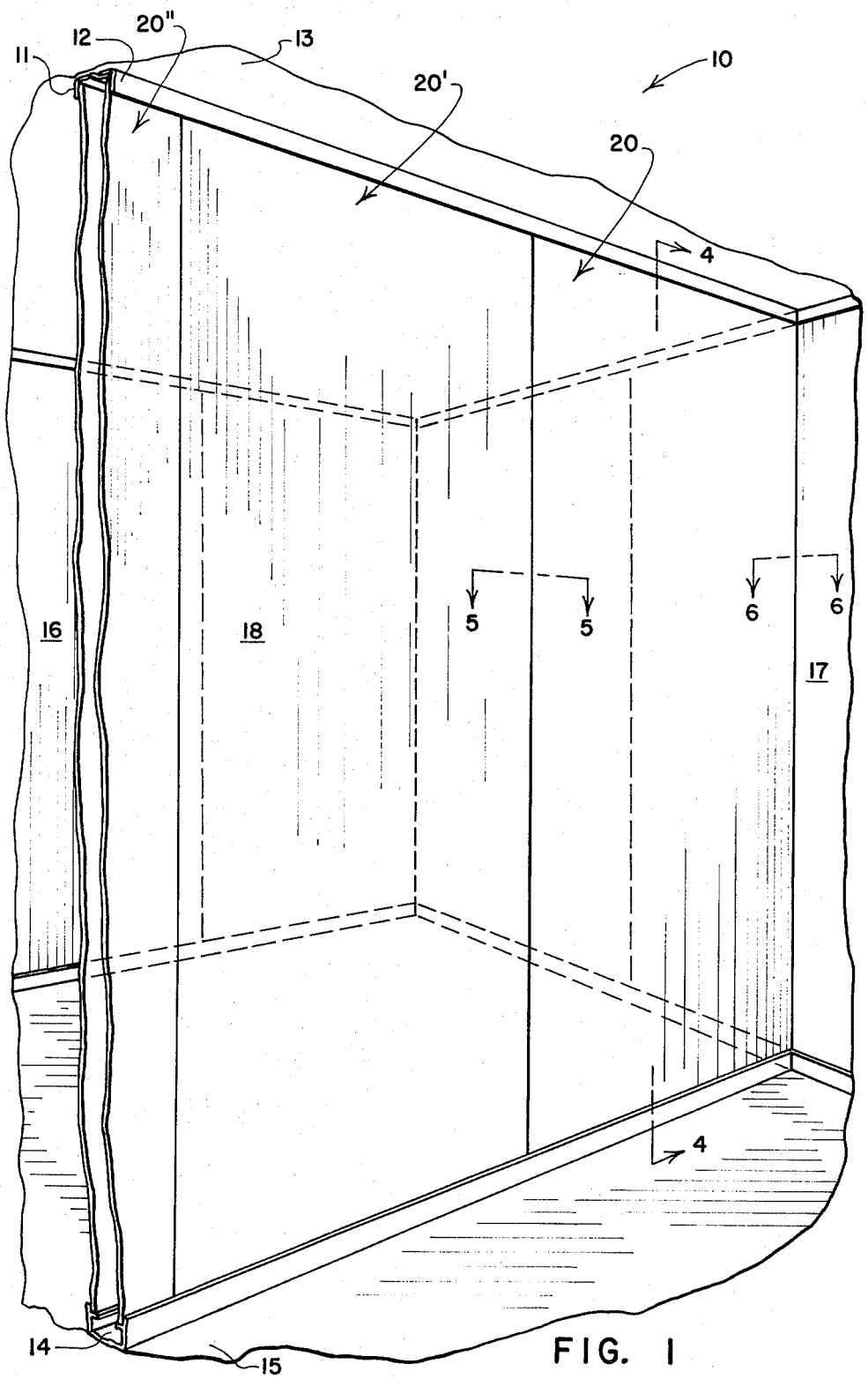
FIG. 1 is a perspective view of assembled components of a building system embodying the preferred practice of the present invention.

Referring to FIG. 1, a building system used to form walls of a building is indicated generally by the numeral 10. The building system 10 employs ceiling runner members 11, 12 which are secured to a preexisting ceiling structure 13, and a floor runner member 14 which is secured to a preexisting floor structure 15. Walls 16, 17 and 18 are shown, each being formed from components embodying the preferred practice of the invention. The walls 16, 17, 18 are formed using dimensionally identical wall panels, top and bottom ends of which are received by the ceiling and floor runner members 11, 12, 13. The wall 18 is shown as comprising three such wall panels, indicated generally by the numerals 20, 20', 20".

Figure 2:
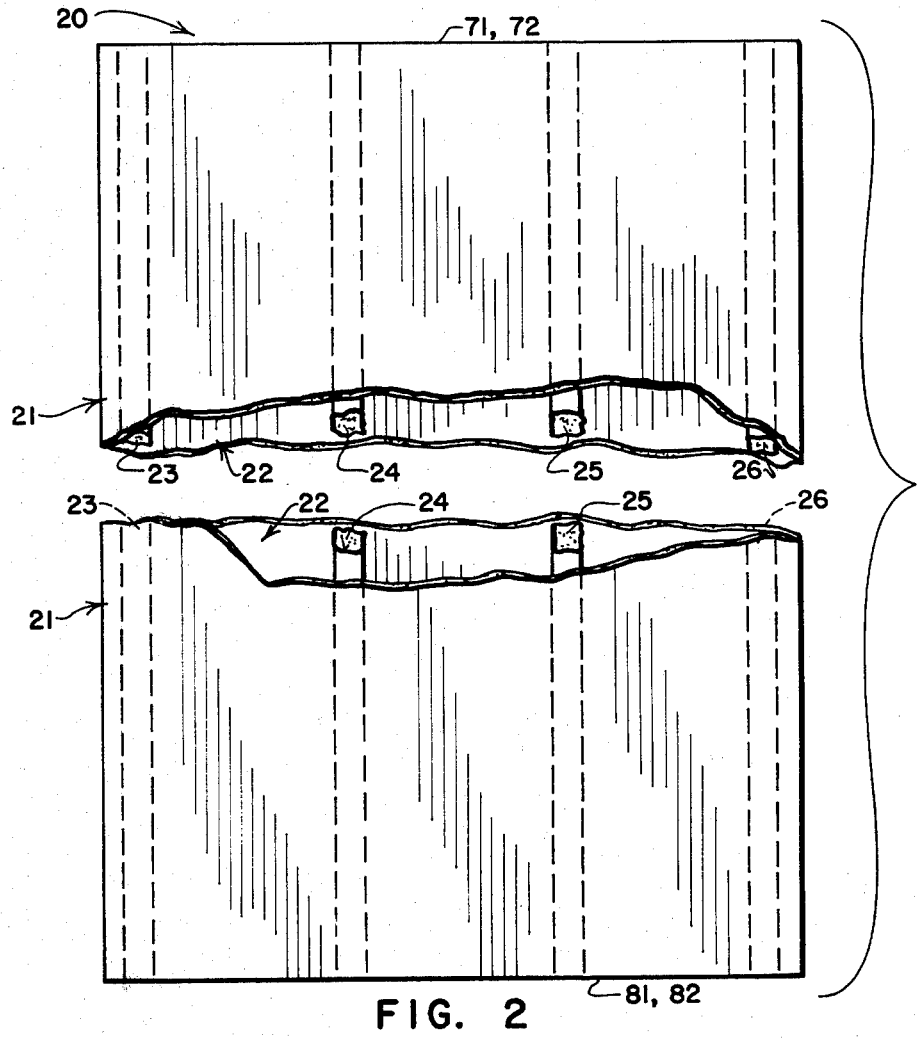
FIG. 2 is a foreshortened side elevational view of a wall panel of the type utilized in the building system of FIG. 1.
Figure 3:
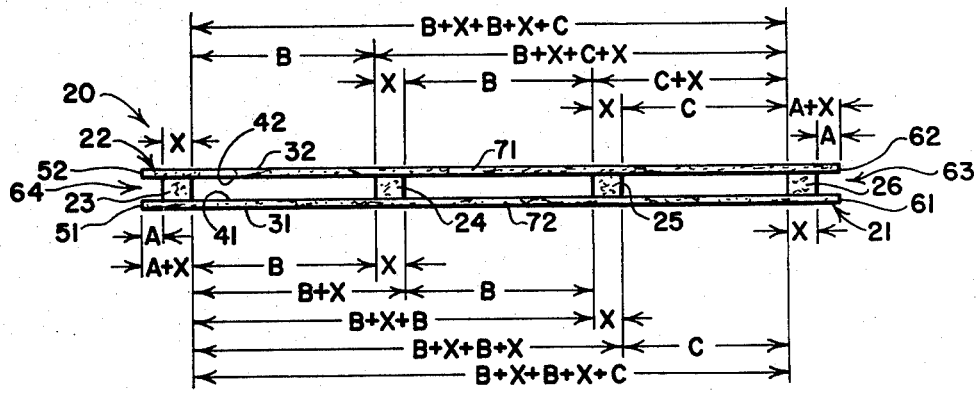
FIG. 3 is a top plan view of the wall panel of FIG. 2.

Referring to FIGS. 2 and 3, the wall panel 20 includes a pair of facing sheets 21, 22 which are spaced apart by and secured to four elongate spacers 23, 24, 25, 26. The facing sheets 21, 22 are dimensionally identical and have front surfaces 31, 32 and back surfaces 41, 42. The front and back surfaces 31, 32, and 41, 42 are interconnected by aligned side surfaces 51, 52 and 61, 62 and by aligned top and bottom end surfaces 71, 72, and 81, 82.

In the preferred practice of the present invention, the facing sheets 21, 22 are gypsum wallboard sheets having a nominal thickness of one half inch, a width of four feet, and a height of eight feet. The gypsum sheets are preferably pre-covered with any suitable decorative vinyl material, or have a porcelain finished metal cover. Porcelain-on-steel gypsum wall sheets are commercially available from Alliance Wall Corporation, Alliance, Ohio 44601. Vinyl covered gypsum wall board sheets are available from a variety of sources. The spacers 23, 24, 25, 26 do not extend beyond the sides and ends of the facing sheets 21, 22. Accordingly, the panel 20 has an overall width of four feet and an overall height of eight feet.

The spacers 23, 24, 25, 26 are preferably formed from a lightweight material which is rigid, has a poor heat transfer capability, and is resistant to fire. One such material is an expanded perlite-containing material blended with binders and fibers and sold under the trademark LAMICOR by Johns-Manville Corporation, Denver, Colo. 80217. A feature of such material is that it is relatively brittle and can be cut off relatively easily by scoring one or more of its outer surfaces and then breaking it as by impact with a hammer.

The preferred cross-sectional dimensions for the spacers 23, 24, 25, 26 are about one-and-five-eighths inches by two inches. The spacers 23, 24, 25, 26 are positioned between the facing sheets 21, 22 in contact with the back surfaces 41, 42 and serve to space the back surfaces 41, 42 by a distance of about one-and-five-eighths inches. The spacers 23, 24, 25, 26 are adhesively bonded to the back surfaces 41, 42 of the facing sheets 21, 22 by any suitable noncombustible adhesive.

The spacers 23, 26 will be called the "outer" spacers since these two spacers are located closest to the sides of the panel 20. The outer spacers 23, 26 are positioned inwardly from their associated side surfaces 51, 52 and 61, 62 by a distance indicated in FIG. 2 by the letter "A". The distance A is preferably about one-and-one-half inches.

The spacers 24, 25 will be called the "inner" spacers since they are located inwardly of the outer spacers 23, 26. The inner spacers 24, 25 are preferably positioned such that, if the panel 20 has to be cut to a narrower width than its normal four-foot width dimension, and, if the proposed line-of-cut (as located by measuring the required width from one of the side surfaces 51, 52) intersects one of the inner spacers 24, 25, then the line-of-cut can be repositioned (as by measuring the required width from one of the side surfaces 61, 62) so that it does not intersect any of the inner spacers 24, 25. A method of arranging each of the inner spacers 24, 25 to achieve this result is to position the inner spacers 24, 25 so that they are located different distances from each of the sides of the panel 20.

A specific and preferred arrangemnt of the inner spacers 24, 25 is illustrated in FIG. 3. Adjacent ones of the spacers 23, 24, 25 are separated by a distance "B". The spacers 25, 26 are separated by a distance "C". Assuming that the spacers 23, 24, 25, 26 each have a width of "X," the dimension "B" is selected to be greater than the dimension "C+X." Hence, if a cutoff panel width is desired which is:

A. within the range of (A+X) to (A+X)+C, such a distance can be measured from either of the panel side surfaces 52, 62 to locate a line-of-cut without causing the line-of-cut to intersect any of the inner spacers 23, 24, 25, 26;

B. within the range of (A+X)+C to (A+X)+(C+X), such distance is less than the distance (A+X)+B and can accordingly be measured from the side surfaces 51, 61 without intersecting the inner stud 24; and, C. within the range (A+X)+B to (A+X)+(B+X), such distance is within the range of (A+X)+(C+X) to (A+X)+(B+X+C) and can accordingly be measured from the side surfaces 52, 62 without intersecting the inner studs 24, 25.

While the above examples do not include all possible panel cutoff widths, they illustrate one relative arrangement of the inner spacers 24, 25 which will achieve the desired objective of preventing lines-of-cut from intersecting the inner spacers 24, 25. A preferred arrangement obtains where the distance B is about thirteen inches and the distance C is about eleven inches, the spacer width X being about two inches.

During fabrication, one of the facing sheets 21 is supported on a horizontal surface with its back surface 41 facing upwardly. The spacers 23, 24, 25, 26 are then adhesively coated on opposite faces and laid in position atop the back surface 41. The other facing sheet 22 is then laid in position atop the spacers 23, 24, 25, 26 and its back surface 42 is adhesively secured to the spacers 23, 24, 25, 26. Suitable pressure is applied to the panel assembly until the adhesive cures sufficiently to maintain the integrity of the panel.

The dimensionally identical wall panels may be fabricated and shipped in a stack atop a suitable pallet, not shown. Adjacent facing sheets of adjacent panels in the stack may have their aligned peripheral surface portions taped together for shipment. The adjacent panels serve to protect each other during shipment and no auxiliary protective covering is required between adjacent facing sheets. Outer panels in the stack are provided with protective sheets of gypsum wall board or with suitable protective wrapping materials to assure that they are not damaged during shipment.

A first step in the erection of the wall 18 shown in FIG. 1 is to secure the ceiling runner member 11 to the ceiling structure 13 along a location where the wall 18 is to join the ceiling structure 13. Secondly, the floor runner 14 is secured to the floor structure 15 along a location where the wall 18 is to join the floor structure 15. Thirdly, a primary junction stud 80, shown in FIG. 6, is secured to the wall 17 at a position extending between the ceiling and floor runner members 11, 14.

Figure 4:
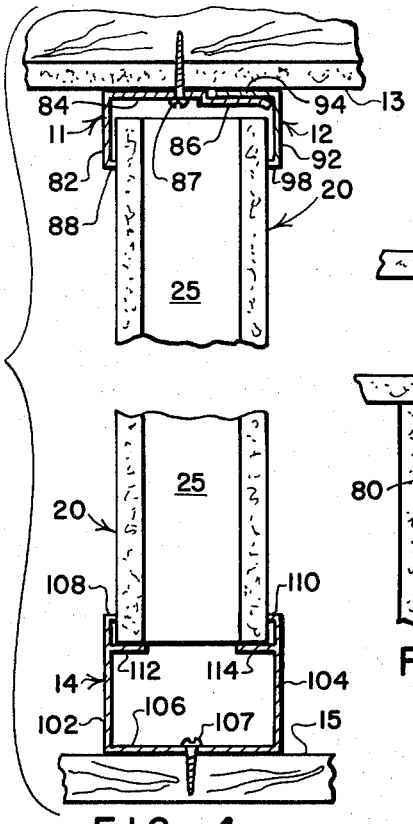
FIGS. 4, 5 and 6 are sectional views as seen from planes indicated by lines 4—4, 5—5 and 6—6 in FIG. 1.

Referring to FIG. 4, the ceiling runner member 11 is an extruded metal strip having a depending side wall portion 82, a horizontally extending mounting portion 84, and a curved receiving portion 86. Driven fasteners such as screws 86 may be used to hold the runner member 11 in place on the ceiling structure 13. An inwardly turned flange 88 is defined at the lower terminus of the depending portion 82. The ceiling runner member 12 is an extruded metal strip having a depending side wall portion 92, a horizontally extending mounting portion 94, and an inwardly turned flange 98 located at the lower terminus of the depending portion 92. The mounting portion 94 is configured to be received in a channel defined between the receiving portion 86 and the ceiling structure 13. Threaded fasteners, not shown, are used to interconnect the ceiling runner members 11, 12 to hold the ceiling runner member 12 in place. The ceiling runner members 12, 13 preferably have lengths of at least two or three panel widths, i.e., at least eight to twelve feet in length.

The floor runner member 14 is a channel-shaped extruded metal structure having upwardly extending side wall portions 102, 104 interconnected by a mounting portion 106. Driven fasteners, such as screws 107 may be used to hold the runner member 14 in place on the floor structure 15. A pair of inwardly turned flanges 108, 110 are provided at the upper ends of the side wall portions 102, 104. A pair of inwardly extending panel supporting formations 112, 114 are provided on the side wall portions 102, 104 at locations below but relatively near to the flanges 108, 110. The floor runner 14 preferably has a length of at least two or three panel widths, i.e., at least eight to twelve feet in length.

Figure 6:
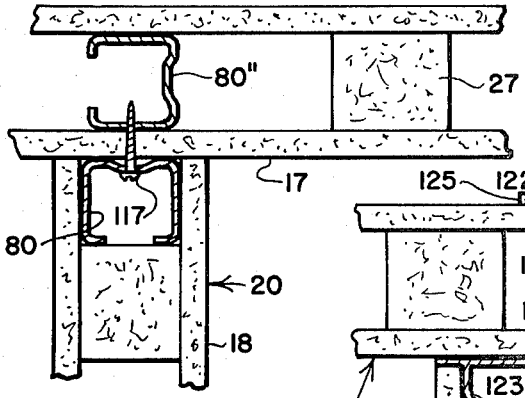

Referring to FIG. 6, the primary juncture member 80 is preferably a commercially available 25 guage metal wall framing stud of the type having a thickness of one and five-eighths inches. Studs of this type are commercially available from a wide variety of building suppliers and have a substantially uniform C-shaped cross sections along their lengths. The junction member 80 extends the full height of its associated wall panels 20, 20', with its bottom end resting on the inwardly turned flanges 112, 114 of the floor runner member 14.

After the runner members 11, 14 and the primary juncture member 80 are in place, the wall panel 20 is then readied for erection. The panel 20 is cut to a length which will permit it to be received by and between the runner members 11, 14. Once the panel 20 has been cut to length, its bottom end is inserted into the upwardly opening channel of the runner 14, and its top end is provided about the longitudinal axis of the floor runner 14 to bring its top end into engagement with the ceiling member 11. The wall panel 20 is then slided longitudinally relative to the ceiling and floor runner members 11, 14 to introduce the juncture member 80 into the side channel 63, with opposed surfaces of the juncture member frictionally engaging, i.e., received in an interference fit between, the back surfaces 41, 42 of the facing sheets 21, 22. Longitudinal movement of the panel 20 is continued until the side surfaces 61, 62 of the facing sheets 21,22 abuttingly engage the wall 17.

Figure 5:
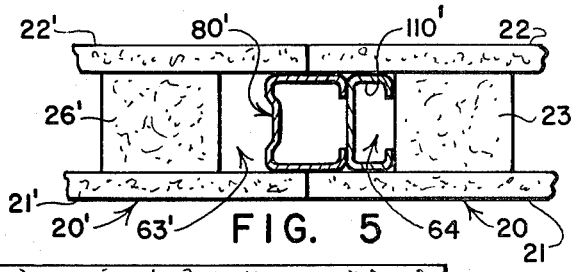

Referring to FIG. 5, once the first wall panel 20 has been installed with the primary juncture member 80 frictionally received within the first side channel 63, at least one filler member 110' is preferably inserted into the second side channel 64. The filler member 110' is an extruded metal member preferably cut to a length of about 3 inches. A plurality of the filler members 110' are preferably used along the length of the second side channel 64, the functions of these members being to facilitate the proper positioning of a second primary juncture member 80'. Once the filler member or members 110' are in position, a second primary juncture member 80' is positioned in the second side channel 64 with opposite sides of the second juncture member 80' frictionally engaging the back surfaces 41, 42 of the facing sheets 21, 22, and with a portion of the second juncture member 80' projecting out of the second side channel 64 for extension into the first side channel 63' of the second wall panel 20'. Once the second juncture member 80' is in position, the second wall panel 20' and other wall panels such as the panel 20" are installed one at a time, with primary juncture members installed therebetween.

When a plurality of the wall panels 20, 20', 20" have been installed, as described, the ceiling runner member 12 is positioned with its mounting portion 94 extending between the receiving portion 86 and the ceiling structure 13, and is pressed toward the ceiling runner member 11 to a position where the facing sheets of the panels 20, 20', 20" are clamped between the inwardly turned flanges 88, 98.

Driven fasteners, not shown, are inserted through aligned holes formed in overlapping portions of the ceiling runner members 11, 12 to secure the runner member 12 in place.

Referring again to FIG. 6, in the event the wall 18 is to abut the wall 17 at a location which is not adjacent a spacer member 27, one of the primary juncture members 80" is preferably inserted between the facing sheets of the panel forming the wall 17 at the location of juncture of the wall 18 to rigidify the wall 17 at the location of the jucture. Driven fasteners such as screws 117 may be utilized to interconnect the juncture members 80, 80".

Figure 7:
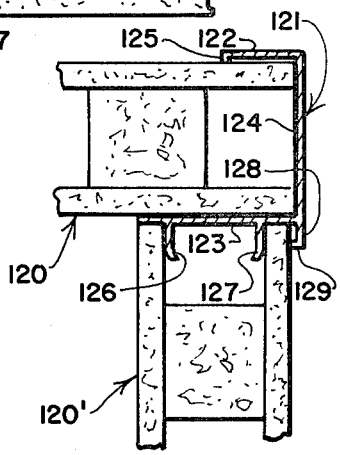
FIG. 7 is a sectional view of a right angle corner construction formed with building system components embodying the preferred practice of the present invention.

Referring to FIG. 7, an outside corner juncture can be formed readily between two wall panels 120, 120' utilizing a specially configured extruded metal juncture member indicated generally by the numeral 121. The juncture member 121 has opposed sides 122, 123 interconnected by an end wall 124. The opposed sides 122, 123 are configured to overlie and to frictionally engage front surfaces of the facing sheets which form the panel 120. An inwardly turned flange 125 is formed at the end of the side 122 to engage one of the facing sheets of the panel 120. A pair of curved, projecting flanges 126, 127 are provided on the side 123 for overlying and frictionally engaging the back wall surfaces of the facing sheets which form the wall panel 120'. The end surface 124 has an extrusion portion 128 which overlies the front surface of one of the facing sheets forming the panel 120', and has an inwardly turned flange 129 which engages this front surface.

Figure 8:
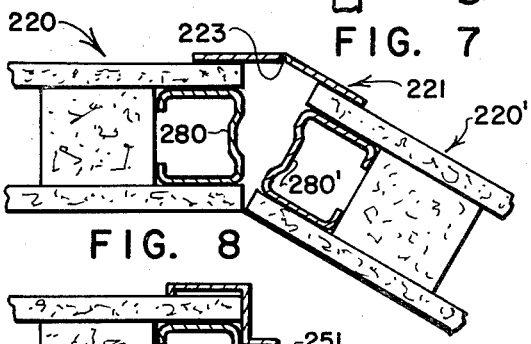
FIG. 8 is a sectional view of an oblique corner construction formed with building system components embodying the preferred practice of the present invention.

Referring to FIG. 8, a corner juncture is readily formed between two abutting wall panels 220, 220' extending in non-coplanar, non-orthogonal relationship by providing a juncture member 221 to cover the open space between spaced facing sheets of the panels 220, 20'. The juncture member 221 is formed from a sheet of metal having a weakened central cross section extending along a line indicated by a numeral 223. The juncture member 221 can be bent about the line 223 to any desired angle to accommodate the oblique angle of the wall panels 220, 220'. Primary juncture members 280, 280' are preferably inserted in the communicating side channels of the panels 220, 220' to reinforce these panels.

Figure 10:
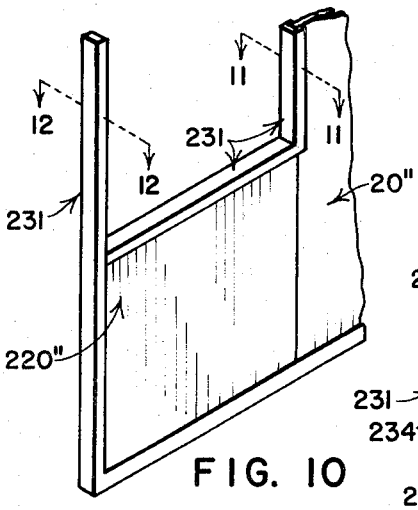
FIG. 10 is a perspective view of a wall portion utilizing a wall panel section which does not extend full height from floor to ceiling.
Figure 11:
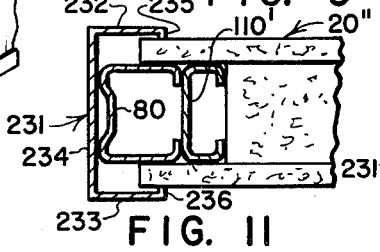
FIGS. 11 and 12 are sectional views as seen from planes as indicated by lines 11—11 and 12—12 in FIG. 10.
Figure 12:
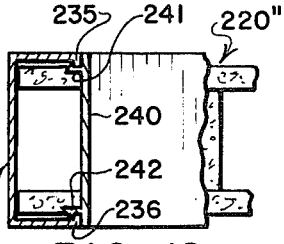

Referring to FIG. 10, in the event it is desired to continue the wall 18 utilizing a short wall panel 220", i.e., a wall panel which does not extend the full height from floor to ceiling, a specially configured cap extrusion 231 is provided for closing exposed side and end portions of the wall panels 20", 220". As is best seen on FIG. 11, the cap member 231 is of channel shaped configuration having a pair of side walls 232, 233 interconnected by an end wall 234. The side walls 232, 233 terminate in inwardly turned flanges 235, 236 and are adapted to overlie and frictionally engage front surface portions of the facing sheets which form the panel 20". Referring to FIG. 12, where the cap member 231 extends above the short wall panel 220", its open side is closed by a cover plate 240 having barbed projection formations 241, 242 adapted to matingly engage the inwardly turned flanges 235, 236. The interfitting cap member and cover plate 231, 240 form a hollow post which can also be used as an electrical raceway.

Figure 9:
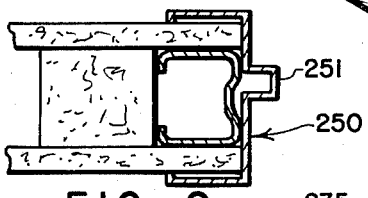
FIG. 9 is a sectional view of a door or window frame construction formed with building system components embodying the preferred practice of the present invention.

Referring to FIG. 9, where window and door openings are formed through or between wall panel portions, a specially configured framing extrusion 250 is provided for covering exposed side and end portions of wall panels around the window and door openings. The framing extrusion 250 is substantially identical to the end cap extrusion 231 with the exception that the end surface is provided with an outwardly extending formation 251 which may serve as a door jam or as a window molding.

Figure 13:
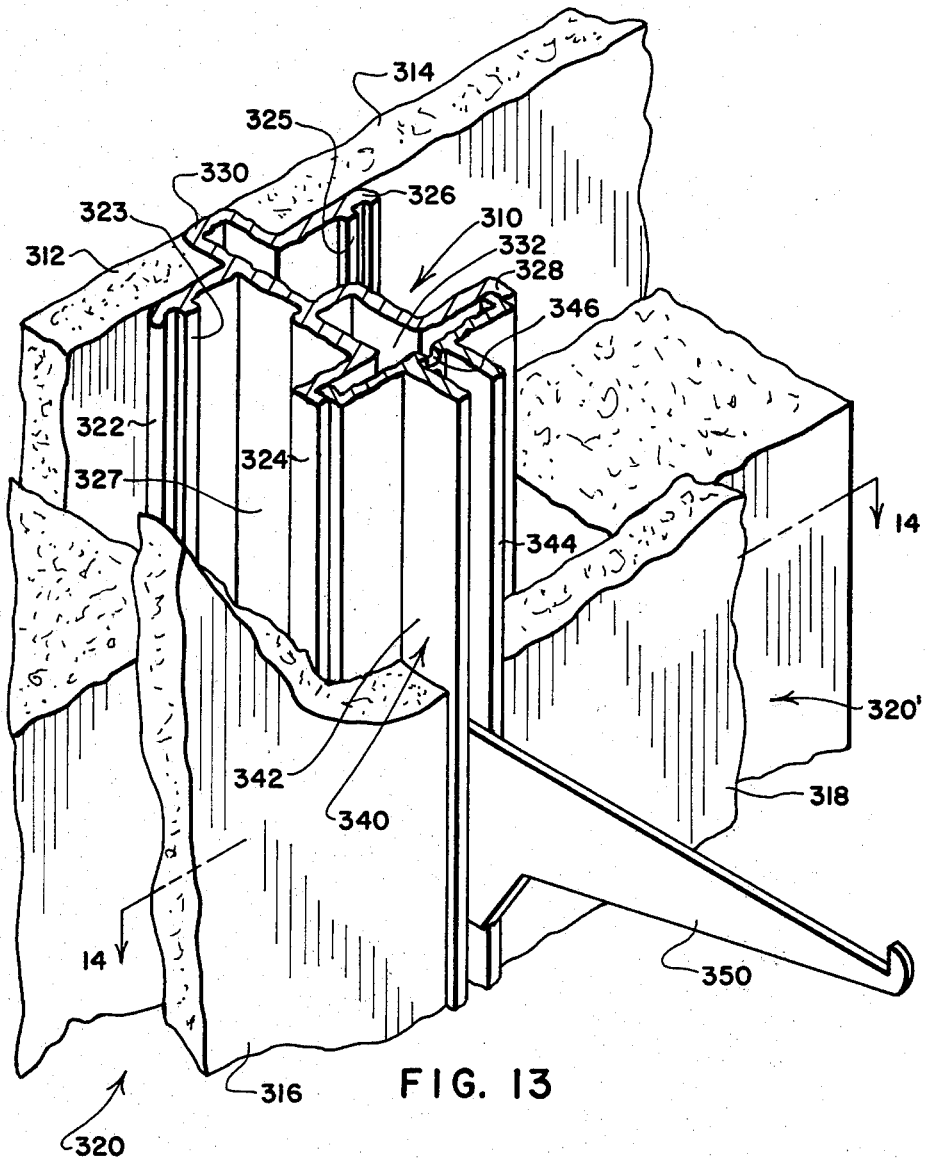
FIG. 13 is a perspective view of a portion of a wall panel junction assembly formed with building system components adapted to releasably support commercially available shelf and cabinet system components.
Figure 14:
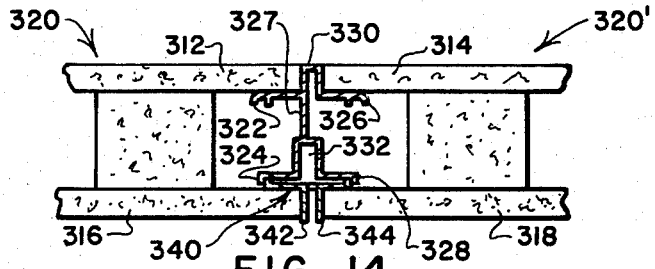
FIG. 14 is a sectional view as seen from a plane indicated by a line 14—14 in FIG. 13.

Referring to FIGS. 13 and 14, in the event it is desired to provide a means for releasably securing conventional shelf and/or cabinet structures to a wall constructed using wall panels of the type previously described, a specially configured junction member 310 is provided for insertion between abutting wall panels 320, 320'. The juncture member 310 has a first set of formations 322, 324 adapted to be inserted in the side of the panel 320 and a second set of formations 326, 328 adapted to be inserted in the side channel of the panel 320'. A pair of ribs 323, 235 are provided on the formations 322, 326. The specially configured junction member 310 also has a spacing formation 330 adapted to be interposed between two of the facing sheets 312, 314 of the adjoining wall panels 320, 320' to space them slightly apart. A connecting web 327 extends transversely between the formations 322, 326 and 324, 328.

The formations 326, 328 define a channel 332 therebetween. The channel 332 is configured to receive a commercially available shelf bracket support member, indicated by the numeral 340. The member 340 has a pair of spaced flanges 342, 344 adapted to extend between and space the facing sheets 316, 318 of the panels 320, 320'. Slots 346 are provided in the member 340 at locations between the flanges 342, 344 to receive conventional shelf mounting brackets 350. The bracket support member 340 is available from Garcy Corporation, Chicago, Ill. 60647, under model number 781.

Figure 15:
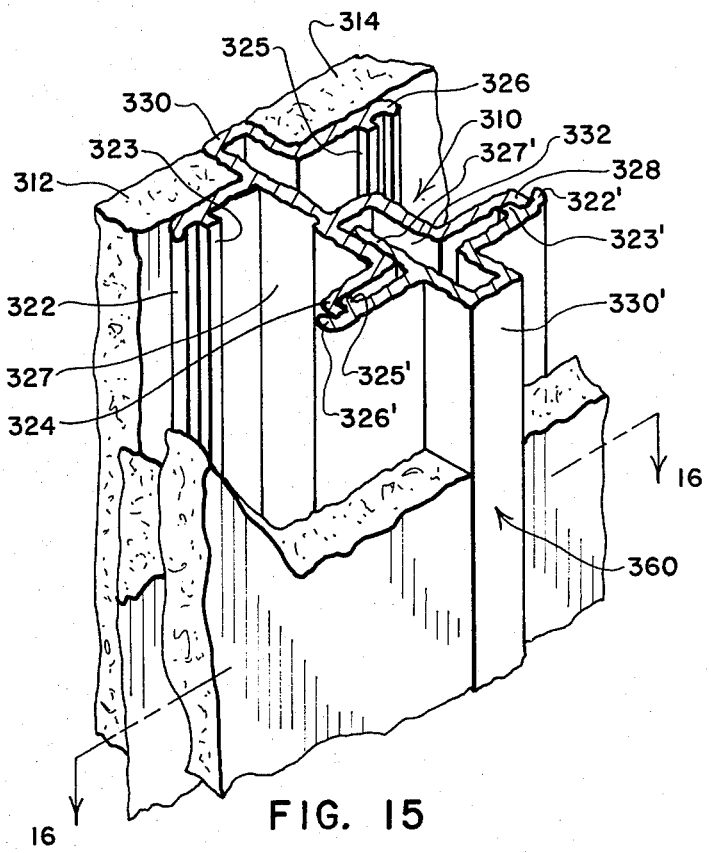
FIG. 15 is a perspective view similar to FIG. 13 of an alternate wall panel junction assembly.
Figure 16:
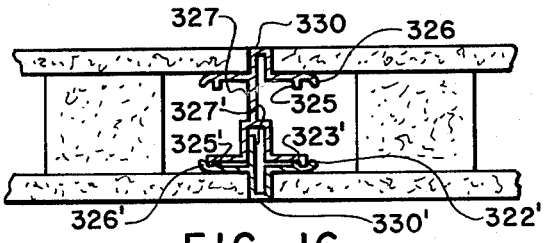
FIG. 16 is a sectional view as seen from a plane indicated by a line 16—16 in FIG. 15; and, FIG. 17 is a perspective view illustrating the use of a novel tool used to facilitate insertion of wall panels into floor runners during erection of a wall.

Referring to FIGS. 15 and 16, in the event that it is not desired to run the shelf bracket member 340 the full height of a joint formed between the two wall panels 320, and 320', a filler member 360 can be inserted either above or below the location occupied by the shelf bracket member 340. The filler member 340 has formations 322', 326' which extend in opposed directions from a spacing formation 330'. A pair of ribs 323', 325' are provided on the formations 322', 326'. A transversely extending web 327' is provided between the formations 322', 326'. As will be readily apparent by comparing the cross sections of the juncture member 310 and the filler member 360, corresponding parts of which are indicated by common numerals (the numerals of the filler member parts bearing a "prime" mark to distinguish them from the juncture member parts), the filler member 360 may be formed by cutting the web of a juncture member 310 in two pieces and discarding the unneeded portions of the cut-in-two juncture member. The ribs 323',325' are spaced to permit their being press fitted between the formations 324, 328, and the web 327' is located such that it extends into the channel 332.

Figure 17:
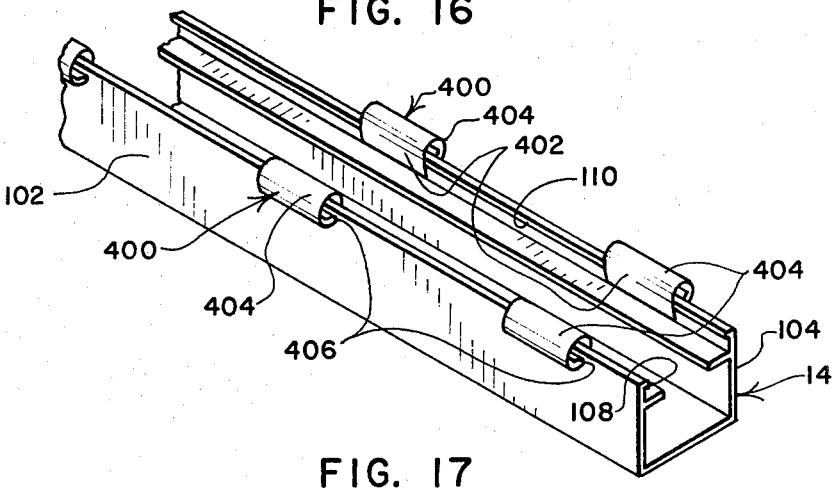

Referring to FIG. 17, specially configured tools 400 may be used to facilitate inserting bottom ends of the wall panels into the upwardly opening channel of the floor runner member 14. The tools 400 are formed from sheet metal strips. Each of the tools 400 has a flat end portion 402 and a curled end portion 404. The curled end portion 404 has a segment 406 which overlies the flat end portion 402 at a narrowly spaced distance therefrom, which distance is selected to permit the tools to be frictionally retained in place on upper ends of the side wall portions 102, 104. When the bottom end of a panel 20 is to be inserted into the floor runner member 14, several of the tools are snapped into place on the side wall portions 102, 104, and their curved end portions 404 serve to guide the bottom end of the wall panel into place between the side wall flanges 108, 110.

Where lightweight fixtures are to be permanently installed on the panels 20, 20', 20", use can be made of conventional expansible fasteners and toggle bolts to hold these fixtures in place. Where heavier fixtures are to be installed permanently on the panels 20, 20', 20'', they may be anchored to extra primary junction studs, not shown, inserted in the panels between spacers 23, 24, 25, 26.

Where electrical wiring must be incorporated in walls constructed using the panels 20, 20', 20'', use can be made of the channel provided by the floor runner 14, and of the open spaces between the panel spacers 23, 24, 25, 26. Alternatively, surface raceways may be secured to the front surfaces of the panels.

While the pre-existing ceiling structure 13 has, for the sake of simplicity, been shown in the drawings as constituting a completed ceiling, it will be understood that in many instances the ceiling structure 13 will constitute nothing more than a metallic gridwork of spaced members arranged to receive and support ceiling tiles.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of erecting a wall in a building having preexisting floor and ceiling structures, comprising the steps of:

(a) providing a plurality of substantially dimensionally identical, substantially rectangular, wall panels each including a pair of facing sheets secured to and held in spaced relationship by spacer means, the facing sheets each having front and back surfaces interconnected by top and bottom end surfaces and by first and second opposed side surfaces, the facing sheets of each panel extending in overlying relationship with their associated side and end surfaces being aligned and cooperating to define top and bottom ends and first and second sides of their wall panel, the spacer means of each wall panel extending between the back surfaces of the associated facing sheets at positions spaced inwardly from the aligned side surfaces of the facing sheets whereby first and second sidewardly facing channels are provided along the first and second sides of each wall panel;

(b) providing elongate preformed ceiling and floor runner structures, wherein:

(i) the ceiling runner structure is adapted to be secured to the ceiling structure, is adapted to receive the top end region of at least one of the wall panels, and has a pair of depending portions adapted to extend from the ceiling structure to positions overlying top portions of the front surfaces of both facing sheets on such wall panel;

(ii) the floor runner structure is adapted to be secured to the floor structure, is adapted to receive the bottom end of at least one of the wall panels, has supporting formations adapted to support the bottom end of such wall panel at a position above the floor structure, and has a pair of upwardly extending portions adapted to extend from the floor structure to positions overlying bottom portions of the front surfaces of both facing sheets on such wall panel;

(c) installing at least parts of the ceiling and floor runner structures on the ceiling and floor structures, respectively, along locations where a new wall is to join the floor and ceiling structures;

(d) providing juncture members each being adapted to extend between the installed ceiling and floor runner structures and each being adapted to be received in one of the side channels of one of the wall panels, with opposed surfaces of the juncture member frictionally engaging the back surfaces of the facing sheets of such wall panel, each further being adapted to be positioned within communicating side channels of two abutting wall panels bridging the plane of juncture between the abutting wall panels and with opposed surfaces of the juncture member frictionally engaging the back surfaces of the facing sheets of both abutting wall panels;

(e) installing a first one of the panels to form a first portion of a new wall joining the floor and ceiling structures at such locations, by;

(i) positioning the bottom end of the first wall panel in engagement with the supporting formations of the installed floor runner structure;

(ii) positioning the top end of the first wall panel in engagement with the installed ceiling runner structure; and, (iii) positioning the first wall panel longitudinally relative to the installed ceiling and floor runner structures at a desired location such that the first side of the first wall panel forms one end of the new wall;

(f) installing a first one of the juncture members in the second channel of the installed first wall panel, the first juncture member being installed such that it extends between the floor and ceiling runner structures and such that it is frictionally received between the back surfaces of the facing sheets of the first wall panel to rigidly support the second side of the first wall panel, the installed first juncture member being positioned such that it has portions protruding from the second side channel of the installed first wall panel, the protruding portions of the installed first juncture member being positioned to be frictionally received between the back surfaces of the facing sheets of a second panel;

(g) installing a second wall panel to provide an extension portion of the new wall, by;

(i) positioning the bottom end of the second wall panel in engagement with the supporting formations of the installed floor runner structure:

(ii) positioning the top end of the second wall panel in engagement with the installed ceiling runner structure; and, (iii) positioning the second wall panel longitudinally relative to the floor and ceiling runner structures to introduce the protruding portions of the installed juncture member into the first side channel of the second wall panel with the protruding portions being frictionally received between the back surfaces of the facing sheets of the second wall panel, and to bring the first side of the second wall panel into abutting engagement with the second side of the installed first wall panel;

(h) installing, in the manner described, as many of the dimensionally identical wall panels as are needed to approximate the desired length of the wall being erected without exceeding such desired length, by cutting a final wall panel to the required additional width to complete the desired length of the wall being erected, and by installing the cut portion of the final wall panel in the manner described to contiguously complete the new wall;

(i) the step of providing dimensionally identical wall panels having spacer means therein includes the step of positioning the spacer means at such locations relative to the sides of their panels as will permit the additional panel width needed to complete the new wall to be cut from a selected wall panel without the line-of-cut intersecting the locations of the spacer means; and, (j) the step of positioning the spacer means includes the steps of:

(i) providing each panel with a pair of elongate outer spacers which are inset from the sides of the panel and which cooperate with the back surfaces of the associated facing sheets to define the first and second side channels;

(ii) providing each panel with at least one elongate inner spacer located between the outer spacers, the at least one inner spacer being located at different distances from the opposite sides of the panel such that if the required panel width for the final panel as measured from one of the panel's sides causes a proposed line-of-cut to intersect the location of such at least one inner spacer, then such line-of-cut can be repositioned by measuring the required panel width from the opposite panel side, and such repositioned line-of-cut will no longer intersect the location of such at least on inner spacer.

2. The method of claim 1 wherein the step of installing as many of the dimensionally identical wall panels as are needed includes the steps of:

(a) installing a second one of the juncture members in the second side channel of the installed second wall panel, the second juncture member being installed such that it extends between the floor and ceiling runner structures and such that it is frictionally received between the back surfaces of the facing sheets of the installed second wall panel to rigidly support the second side of the second wall panel, the installed second juncture member being positioned such that it has portions protruding from the second side channel of the installed second wall panel, the protruding portions of the installed second juncture member being positioned to be frictionally received between the back surfaces of the facing sheets of a third wall panel; and, (b) installing a third wall panel to provide a further extension portion of the new wall, by:

(i) positioning the bottom end of the third wall panel in engagement with the supporting formations of the floor runner structure;

(ii) positioning the top end of the third wall panel in engagement with the installed ceiling runner structure; and, (iii) positioning the third wall panel longitudinally relative to the floor and ceiling runner structures to introduce the protruding portions of the installed second juncture member into the first side channel of the third wall panel with the protruding portions of the second juncture member being frictionally received between the back surfaces of the facing sheets of the third wall panel, and to bring the first side of the third wall panel into abutting engagement with the second side of the installed second wall panel.

3. The method of claim 1 additionally including the step of rigidifying the first side of the first wall panel by positioning a further one of the juncture members within the first side channel thereof with opposed surfaces of the further juncture member frictionally engaging the back surfaces of the facing sheets of the first wall panel.

4. The method of claim 3 wherein the step of positioning the further juncture member is effected by installing the further juncture member such that it extends between the installed ceiling and floor runner structures, the installation of the further juncture member being effected prior to the positioning of the first wall panel, the step of positioning the first wall panel being effected in such a way as causes the installed further juncture member to be introduced into the first side channel of the first wall panel.

5. The method of claim 1 wherein, once the new wall has been erected such that it comprises a plurality of side-by-side wall panels with the first and last installed panels defining opposite ends of the new wall, the wall panel forming one of the ends of the new wall is rigidified by installing on elongate channel-shaped end cap about side portions thereof, the end cap being operable to close the open side channel of such panel and having portions which extend into overlying engagement with the front surfaces of the facing sheets of such panel.

6. The method of claim 1 wherein, once a first new wall has been erected such that it comprises a plurality of side-by-side wall panels with the first and last installed panels defining opposite ends of the first new wall, a second new wall is formed adjacent one end of the first new wall and extending at a predetermined angle less than 180 degrees relative to the plane of the first new wall by:

(a) installing at least parts of other ceiling and floor runner structures on the ceiling and floor structures, respectively, along second locations where the second new wall is to join the floor and ceiling structures, the other runner structures being configured and positioned to contiguously engage the ceiling and floor runner structures of the first new wall;

(b) installing an additional one of the wall panels to form a first portion of the second new wall joining the floor and ceiling structures at such second locations, by:

(i) positioning the bottom end of the additional wall panel in engagement with the supporting formations of the installed other floor runner structure;

(ii) positioning the top end of the additional wall panel in engagement with the installed other ceiling runner structure; and, (iii) positioning the additional wall panel longitudinally relative to the installed other ceiling and floor runner structures to bring the additional wall panel to a position where the side of at least one of its facing sheets extends substantially adjacent the side of at least one of the facing sheets of the wall panel which defines the one end of the first new wall; and (c) installing a bridging member to bridge such open space as may be present between the additional wall panel and the wall panel which defines the one end of the first new all.

7. The method of claim 6 wherein:

(a) the bridging member comprises a flat elongate sheet which has been bent along a center line, whereby the flat sheet assumes a substantially V-shaped cross section with the included angle between the legs of the V-shaped cross section being the same as the predetermined angle, and with the legs being of sufficient width to permit each of them to overlie portions of the facing sheets of a separate one of the wall panels forming a corner between the first and second new wall; and, (b) the step of installing the bridging member includes securing the bridging member in place with each of its legs overlying such facing sheet portions.

8. The method of claim 6 wherein:

(a) the bridging member comprises an extruded member having a uniform cross section along its length and having first and second sets of formations, the first set of formations being adapted to frictionally engage both facing sheets of the wall panel which defines the one end of the first new wall, and the second set of formations being adapted to frictionally engage both facing sheets of the additional wall panel; and, (b) the step of installing the bridging member is effected by bringing the first set of formations into frictional engagement with both facing sheets of the wall panel defining the one end of the first new wall, and by bringing the second set of formations into frictional engagement with both facing sheets of the additional wall panel.

9. The method of claim 8 wherein:

(a) one of the sets of formations is configured to overlie front surface portions of its associated facing sheets, and the other of the sets of formations is configured to overlie back surface portions of its associated facing sheets; and, (b) the step of installing the bridging member is effected by bringing the one set of formations into overlying engagement with the front surface portions of its associated facing sheets, and by bringing the other set of formations into overlying engagement with the back surface portions of its associated facing sheets.

10. The method of claim 1 wherein the first new wall is formed of a desired length by installing, in the manner described, as many of the dimensionally identical wall panels as are needed to approximate the desired wall length without exceeding such length, by cutting a final wall panel to the required additional width to complete the desired length of the new wall, and by installing the cut portion of the final wall panel in the manner described to contiguously complete the new wall.

11. The method of claim 1 wherein:

(a) the step of providing the ceiling runner structure includes the steps of providing a two-part ceiling runner structure, each of the parts having mating formations adapted to be received in mating engagement with corresponding formations on the other of the parts and each of the parts carrying one of the depending portions;

(b) the step of installing at least a part of the ceiling runner structure including the step of installing a first one of the two ceiling runner parts on the ceiling structure;

(c) the steps of positioning the top ends of wall panels in engagement with the installed ceiling runner structure being effected by bringing the front surface of one of the facing sheets of each such panel into engagement with the depending portion of the installed ceiling runner structure part;

(d) completion of installation of the ceiling runner structure being effected after the wall panels have been installed by bringing the mating formation of the second ceiling runner structure part into mating engagement with the mating formation of the installed first ceiling runner structure part, and by bringing the depending formation of the second ceiling runner structure part into engagement with the front surfaces of the other facing sheets of the installed panels.

12. The method of claim 1 wherein, once a first new wall has been erected such that it comprises a plurality of side-by-side wall panels, a second new wall is formed extending from a facing sheet of one of the installed wall panels forming the first new wall at substantially a right angle relative thereto by:

(a) installing at least part of other ceiling and floor runner structures on the ceiling and floor structures, respectively, along second locations where the second new wall is to join the floor and ceiling structures, the other runner structures being positioned to abuttingly engage the installed ceiling and floor runner structures of the first new wall;

(b) installing a selected one of the juncture members along the front surface of the facing sheet which is to be abutted by the second new wall and extending between the installed other runner structures;

(c) installing an additional one of the wall panels to form a first portion of the second new wall joining the floor and ceiling structure at such second locations, by;

(i) positioning the bottom end of the additional wall panel in engagement with the supporting formations of the installed other floor runner structure;

(ii) positioning the top end of the additional wall panel in engagement with the installed other ceiling runner structure; and, (iii) positioning the additional wall panel longitudinally relative to the installed other ceiling and floor runner structure to introduce the installed selected juncture member in the first side channel of the additional wall panel and to bring the additional wall panel to a position wherein the first side thereof abuts the installed first new wall.

13. The method of claim 12 additionally including the step of installing a further juncture member between the facing sheet of the wall panel of the first new wall adjacent the location where the second new wall is to abut the first new wall, thereby the first new wall is rigidified in the region of its juncture with the second new wall.

14. The method of claim 13 additionally including the step of installing fastener means to interconnect the selected and further juncture members.

15. The method of claim 1 additionally including the steps of:

(a) installing a second one of the juncture members in the second side channel of the installed second wall panel, the second juncture member being installed such that it extends between the floor and ceiling runner structures and such that it is frictionally received between the back surfaces of the facing sheets of the installed second wall panel to rigidly support the second side of the second wall panel, the installed second juncture member being positioned such that it has portions protruding from the second side channel of the installed second wall panel, the protruding portions of the installed second juncture member being positioned to be frictionally received between the back surfaces of the facing sheets of a third wall panel;

(b) cutting a third wall panel so that it has a height less than that required to extend between the installed floor and ceiling runner structures;

(c) installing the cut off third wall panel to provide a further extension portion of the new wall which has a height that does not extend entirely to the ceiling structure, by;

(i) positioning the bottom end of the third wall panel in engagement with supporting formations of the floor runner structure;

(ii) positioning the third wall panel longitudinally relative to the floor and ceiling runner structures to introduce the protruding portions of the installed second juncture member into the first side channel of the third wall panel with the protruding portion of the second juncture member being frictionally received between the back surfaces of the facing sheets of the third wall panel and to bring the first side of the third wall panel into abutting engagement with the second side of the installed second wall panel; and, (iii) installing a channel-shaped cover over the cut-off upper end of the third wall panel to close the open upper end of such panel, the cover having portions which extend into overlying engagement with the front surfaces of the facing sheets of such panel.

16. The method of claim 15 additionally including the step of rigidifying the second side of the installed third wall panel by installing an elongate, channel-shaped member about the second side thereof, the channel-shaped member being operable to close the open second side channel of such panel and having portions which extend into overlying engagement with the front surfaces of the facing sheets of such panel, and having upper portions extending above the top end of the cut off third panel for connecting to the ceiling structure; and (a) installing a closure member on such portions of the channel shaped member as extend above the upper end of the cut off third wall panel to close the open channel defined by the channel-shaped member.

17. The method of claim 1 additionally including the steps of:

(a) forming an opening through one or more of the installed wall panels to provide a door or window opening; and, (b) framing at least portions of such opening by fitting at least one channel-shaped member into engagement with wall panel portions defining such opening, the channel-shaped member having portions which overlie and frictionally engage the facing sheets of such panel portion.

18. The method of claim 1 wherein:

(a) the spacer means used in each of the wall panels include at least a pair of elongate outer spacer members extending substantially the full height of their respective panels between the bottom and top ends thereof and being inset from the sides thereof to cooperate with the back surfaces of the facing sheets thereof to define the first and second side channels; and, (b) the method additionally includes the step of installing at least one filler member in the second side channel of the installed first wall panel, the filler member being frictionally received between the back surfaces of the facing sheets of the first wall panel and being positioned in abutting relationship with the outer spacer member associated with the second side channel; and, (c) the step of installing the first juncture member including the step of positioning the first juncture member in engagement with the filler member.

19. The method of claim 1 additionally including the steps of:

(a) providing a specially configured elongate juncture member adapted to extend between the installed ceiling and floor runner structures and having first and second sets of formations on opposite sides thereof, each of the sets of formations extending substantially the full length of the specially configured juncture member and each being adapted to be received in a separate one of the side channels of separate ones of the wall panels with opposed surfaces of the formations frictionally engaging the back surfaces of the facing sheets of such wall panels, and having third and fourth formations adapted to extend between and to uniformly space the sides of a pair of wall panels, at least one of the third and fourth formations being provided with structure adapted to releasably receive shelf support means for supporting a shelf on the specially configured juncture member; and, (b) installing the specially configured juncture member such that its first set of formations extends into the second side channel of the second wall panel;

(c) installing a third wall panel in substantially the same manner as the first and second wall panels with the first side channel of the third wall panel receiving the second set of formations of the specially configured juncture member.

20. The method of claim 1 wherein the step of providing wall panels includes the step of forming the spacer means from an expanded perlite-containing material.

21. The method of claim 1 wherein the step of installing the runner structures is effected by installing the runner structures in sections abutted end-to-end to provide substantially contiguously extending installed runner structures.

22. A system for forming a wall of a building which has preexisting floor and ceiling structures, the system comprising:

(a) a plurality of substantially dimensionally identical, substantially rectangular, wall panels each including a pair of facing sheets secured to and held in spaced relationship by spacer means, the facing sheets each having front and back surfaces interconnected by top and bottom end surfaces and by first and second opposed side surfaces, the facing sheets of each panel extending in overlying relationship with their associated side and end surfaces being aligned and cooperating to define top and bottom ends and first and second sides of their wall panel, the spacer means of each wall panel extending between the back surfaces of the associated facing sheets at positions spaced inwardly from the aligned side surfaces of the facing sheets whereby first and second sidewardly facing channels are provided along the first and second sides of each wall panel, such wall panels being installable side-by-side to form a substantially continuous wall;

(b) preformed ceiling and floor runner structures, wherein:

(i) the ceiling runner structure being configured to be secured to the ceiling structure, being configured to receive the top end region of at least one of the wall panels, and having a pair of depending portions configured to extend from the ceiling structure to positions overlying top portions of the front surfaces of both facing sheets on such wall panel;

(ii) the floor runner structure being configured to be secured to the floor structure, being configured to receive the bottom end of at least one of the wall panels, having supporting formations adapted to support the bottom end of such wall panel at a position above the floor structure, and having a pair of upwardly extending portions adapted to extend from the floor to positions overlying bottom portions of the front surfaces of both facing sheets on such wall panel;

(c) a plurality of juncture members, each being configured to extend between the installed ceiling and floor runner structures and each being configured to be received in one of the side channels of one of the wall panels, with opposed surfaces of the juncture member frictionally engaging the back surfaces of the facing sheets of such wall panel, each further being configured to be positioned within communicating side channels of two abutting wall panels bridging the plane of juncture between the abutting wall panels and with opposed surfaces of the juncture member frictionally engaging the back surfaces of the facing sheets of both abutting wall panels.

(d) the spacer means comprising a plurality of elongate spacer members extending between the facing sheets of their associated panel and cooperating to support such facing sheets in spaced, rigidly interconnected, overlying relationship, the spacer members extending parallel to the sides of the panels;

(e) the spacer members within each panel including a pair of outer spacers which are inset from the two sides of the panel and which cooperate with back surfaces of the facing sheets to define first and second side channels between the facing sheets, and at least one inner spacer located between the outer spacers;

(f) the at least one inner spacer being located at different distances from the two sides of its panel such that, if less than a full panel width is needed to complete a wall being built, and if the required panel width as measured from one of the panel's sides causes a proposed line-of-cut to intersect such at least one inner spacer, then such line-of-cut can be repositioned by measuring the required panel width from the opposite panel side, and such repositioned line-of-cut will no longer intersect such at least one inner spacer.

23. The system of claim 22 wherein the at least one inner spacer includes a plurality of inner spacers, each of which is positioned at a different distance from the two sides of its associated panel such that, if the proposed line-of-cut intersects any one of such inner spacers, such line-of-cut can be repositioned by measuring the required width from the opposite panel side, and such repositioned line-of-cut will no longer intersect any of the inner spacers.

24. The system of claim 22 wherein:

(a) the facing sheets are gypsum wallboard sheets;

(b) the spacer means are formed from an expanded perlite-containing material; and, (c) the spacer means are adhesively bonded to their associated facing sheets.

25. The system of claim 22 additionally including elongate channel-shaped cap means for positioning over exposed side or end portions of a wall panel to cover such portions, the cap means having portions adapted to extend in overlying engagement with the front surfaces of the facing sheets of such wall panel portions.

26. The system of claim 22 additionally including elongate bridging member means for covering such open space as may be present when a pair of wall panels are installed in abutting, non-coplanar relationship.

27. The system of claim 26 wherein the bridging member comprises a flat, elongate sheet which has been bent along a center line whereby the flat sheet assumes a substantially V-shaped cross section with the included angle between the legs of the V-shaped cross section being the same as the angle between the non-coplanar wall panels and with the legs being of sufficient width to permit each of them to overlie portions of the facing sheets of separate ones of the non-coplanar abutting wall panels.

28. The system of claim 26 wherein the bridging member means comprises an extruded member having a uniform cross-section along its length and having first and second sets of formations, the first set of formations being configured to frictionally engage both facing sheets of a first one of the wall panels, the second set of formations being configured to frictionally engage both facing sheets of a second of the wall panels.

29. The system of claim 28 wherein the first set of formations is configured to overlie front surface portions of the first of the facing sheets, and the second set of formations is configured to overlie back surface portions of the second of the facing sheets.

30. The system of claim 22 wherein the ceiling runner structure includes a pair of ceiling runner members, each of the members having mating formations configured to be received in mating engagement with corresponding formations on the other of the members and each of the members carrying one of the depending portions.

31. The system of claim 22 additionally including filler means positionable in one of the side channels of a panel to facilitate the proper positioning of a juncture member to bridge the juncture between the one panel and an abutting wall panel.

32. The system of claim 22 additionally including a specially configured juncture means adapted to extend between the installed ceiling and floor running structures and having first and second sets of formations on opposite sides thereof, such of the sets of formations extending substantially the full length of the specially configured juncture means and each being adapted to be received in a separate one of the side channels of separate ones of the wall panels with opposed surfaces of the formations frictionally engaging the back surfaces of the facing sheets of such wall panels, and having third and fourth formations adapted to extend between and to uniformly space the sides of a pair of wall panels.

33. The systems of claim 32 wherein at least one of the third and fourth formations is being provided with structure adapted to releasably receive shelf support means for supporting a shelf on the specially configured juncture means.

34. The system of claim 32 wherein selected ones of the first, second, third and fourth formations are provided on separate interfittable members.

35. The system of claim 34 wherein one of the separate interfittable members have different configurations and one of these members can be formed by a cut-off part of the other.

36. The system of claim 22 additionally including channel-shape framing means for covering exposed side and end portions of one or more wall panels adjacent a door or window opening formed through or between such panels, the channel shaped means having portions adapted to extend in overlying engagement with front surface portions of the facing sheets of such panels.

37. The system of claim 22 additionally including tool means adapted to be removably supported on the floor runner structure for guiding wall panels into receiving relationship with the floor runner structure.

* * * * *